United States Patent [19]

Browne

[11] Patent Number: 5,021,773

[45] Date of Patent: Jun. 4, 1991

[54] FIBRE OPTIC DISPLAY DEVICE

[75] Inventor: John Browne, Oakville, Canada

[73] Assignee: NEI Canada Limited, Rexdale, Canada

[21] Appl. No.: 321,188

[22] Filed: Mar. 9, 1989

[30] Foreign Application Priority Data

Jun. 29, 1988 [CA] Canada ..... 570687

[51] Int. Cl.[5] ..... G09F 3/04

[52] U.S. Cl. ..... 340/764; 340/783; 340/815.31; 40/447; 40/474; 40/449; 40/452

[58] Field of Search ..... 340/764, 763, 783, 815.2, 340/815.31, 815.08; 40/447, 449, 473, 474, 452, 451

[56] References Cited

U.S. PATENT DOCUMENTS 3,469,258 9/1969 Winrow ..... 340/764

4,819,357 4/1989 Salam ..... 340/763

4,833,806 5/1989 Gars ..... 340/564

FOREIGN PATENT DOCUMENTS 0054336 6/1982 European Pat. Off. .

2141858 12/1985 United Kingdom ..... 340/764

*Primary Examiner*—Alvin E. Oberley

[57] ABSTRACT

A display device has a disk assembly with a SET position and a RESET position approximately perpendicular and approximately parallel to the intended viewing direction. The disk assembly shows a bright indication in the viewing direction in SET position and a dark indication at the same viewing area in the RESET position. An aperture in the disk allows radiation from an optic fibre to be seen from the viewing direction in SET position and a hood, mechanically attached to the disk assembly occludes such radiation in the reset position.

4 Claims, 3 Drawing Sheets

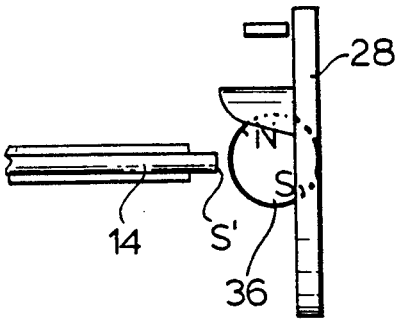
FIG. 2A.
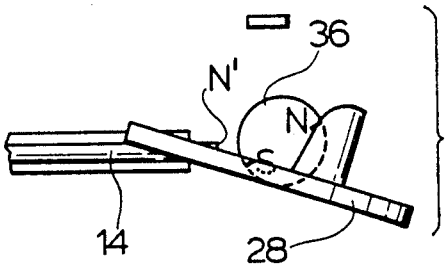
FIG. 3A.
FIG. 1.
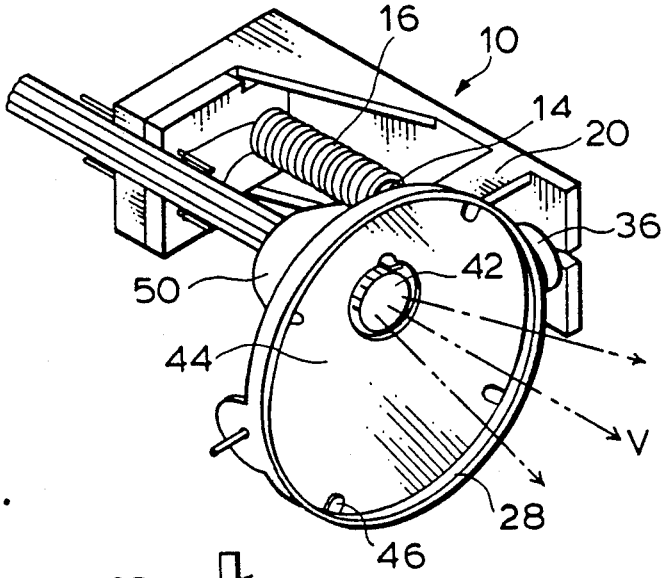
FIG. 2.
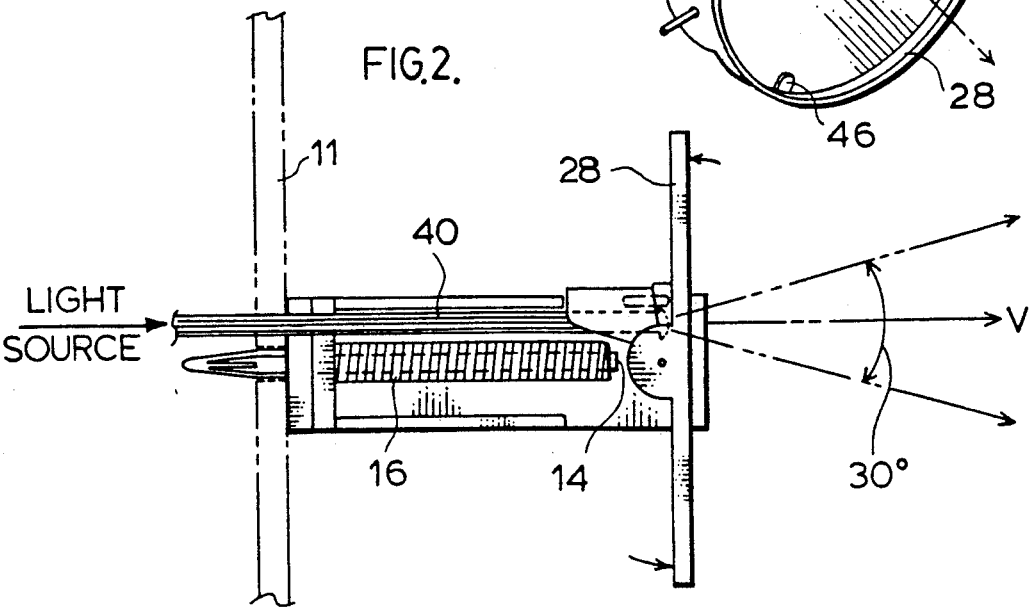

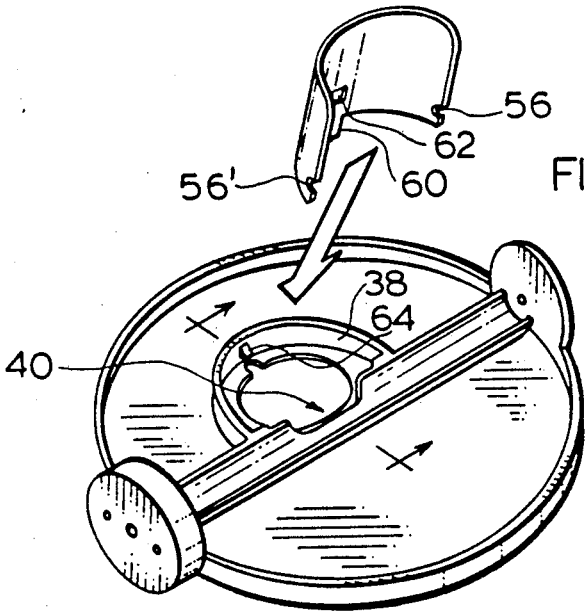
FIG.7.
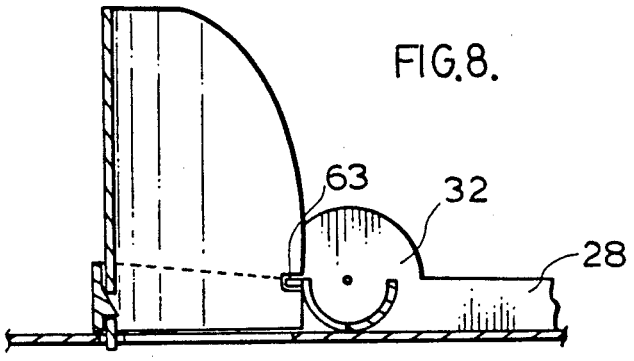
FIG.8.
FIG.9.
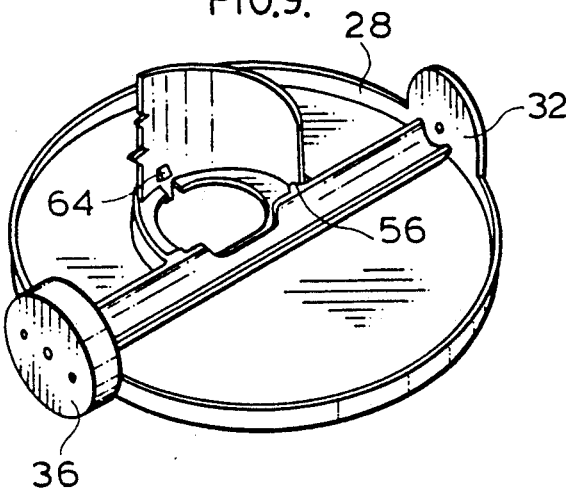

FIBRE OPTIC DISPLAY DEVICE

This invention relates to a display device having a rotor designed to rotate between SET and RESET positions, in said SET position to give a light or bright indication in a viewing direction; and in the RESET position to give a contrasting indication at the disk location in the viewing direction.

Such a display element may be used singly as a binary indicator or in an array to collectively indicate letters numbers or design.

European patent application 864015839 inventor Jacques Le Gars, published Feb. 4, 1987 under number 0 210 913 shows a display device rotatable between SET and RESET position and where a disk is designed to be perpendicular to and show a light color in the viewing direction in SET position and, (primarily for night viewing) is apertured so that in SET position, a fibre optic terminal illuminated by a suitable light source is designed to shine through said aperture in the viewing direction. The device is designed so that it may be selectively rotated to the RESET position where the back of the disk or the background corresponding to the SET disk location is contrastingly dark. Where the disk is rotated only about 90° there must be mounted thereon a barrier to block optic radiation from the fibre optic terminal which would otherwise be visible in the viewing direction.

Forward and rearward herein relate to the directions toward and away from the intended position of the viewer. Forward and rearward in relation to the disk or disk assembly refer to those directions when the disk is in the SET position.

It is an object of the invention to provide a pivotally mounted display element of the aforesaid type to rotate between 90° and 120° with the barrier in the form of a light (in weight) hood which may be simply mechanically attached to the rear of the disk assembly in a location to occlude radiation from the fibre optic terminal in the RESET position. The aperture and fibre optic terminal are offset to one side of the pivot axis as viewed in the viewing direction. The rearwardly projecting hood is located on the side of the aperture farthest from the pivot axis to reach occluding position in the RESET position. By mechanically I mean attached by the shaping and/or flexure of the parts.

It is an object of a preferred aspect of the invention described in the previous paragraph to provide such hood as a thin sheet of resilient plastic bent to be concave toward the outer edge of the aperture and to partially surround it. However the strenghthening of such attachment by adhesive or other means is considered within the scope of the invention. The hood as thus arranged and mounted may be very light and is effective to block the light from the fibre terminal in the RESET position of the disk assembly.

It is an object of a preferred aspect of the invention to provide a display element having a disk assembly as described in the preceding paragraph wherein said hood and disk are cooperatively designed so that said bent hood flexes against detents on said disk assembly to be held in position.

It is an object of a preferred aspect of the invention to provide a pivotally mounted display element of the aforesaid type designed to rotate between 90° and 120° with the disk assembly comprising a frame with a disk mounted thereon with the barrier in the form of a light (in weight) hood which may be simply mechanically attached to the frame to project rearwardly therefrom.

It is an object of the invention as discussed in the preceding paragraph to provide that the hood is formed of a flat sheet of resilient material bent to be concave toward the aperture edges on the side of the latter farther from the pivot axis.

It is an object of the invention as described in the preceding paragraph to provide a device where the hood is retained in place and in its bent attitude by detents attached to the frame retaining the hood against outward flexing.

It is an object of the invention as discussed in the preceding paragraph to provide a display device where the hood keys to the disk to prevent rotation of the latter relative to the frame.

It is an object of the invention as discussed in the second preceding paragraph where the hood is designed for connection to a frame detent fixing said hood against movement forward or rearward relative to the frame.

It is an object of the invention to provide a display element with a pivotally mounted disk assembly to rotate between 90° and 120° where the disk assembly comprises a frame and a disk attached thereto where the frame comprises a peripheral ring and a diametrically extending central bar having a curved strut in the general plane of the ring and with its ends attached to the central strut, where the disk is apertured to allow a glass fibre terminal to radiate light in the viewing direction and the hood is formed of the resilient material bent in a shape concave toward the edge of the aperture remote from the pivot point, said curved strut being shaped to located and to support said hood in position on said frame and strut designed to provide detents to prevent outward movement of the ends of said flexed hood and said strut being provided with means in cooperation with said hood to prevent forward or rearward movement thereof.

It is an object of the invention to provide a display element with a pivotally mounted disk assembly where the disk assembly comprises a frame and a disk attached thereto and where the frame comprises a peripheral ring and a diametrically extending central bar having a curved strut in the general plane of the ring and with its ends attached to the central bar, the strut and frame being designed so that a hood may be mounted thereon if the device is used with a glass fibre. However the simple arrangement of frame, bar and strut is light enough that the display element formed therewith may, as well, be used for other element applications without the glass fibre illumination.

In drawings which illustrate a preferred embodiment of the invention.

FIG. 1 is a perspective view of a device in accord with the invention.

FIG. 2 is a side view in the SET position.

FIG. 2A shows the magnet position for SET position.

FIG. 3A shows the magnet position for RESET position.

FIGS.7–9 illustrate the attachment of the hood to the frame.

Figure 3:
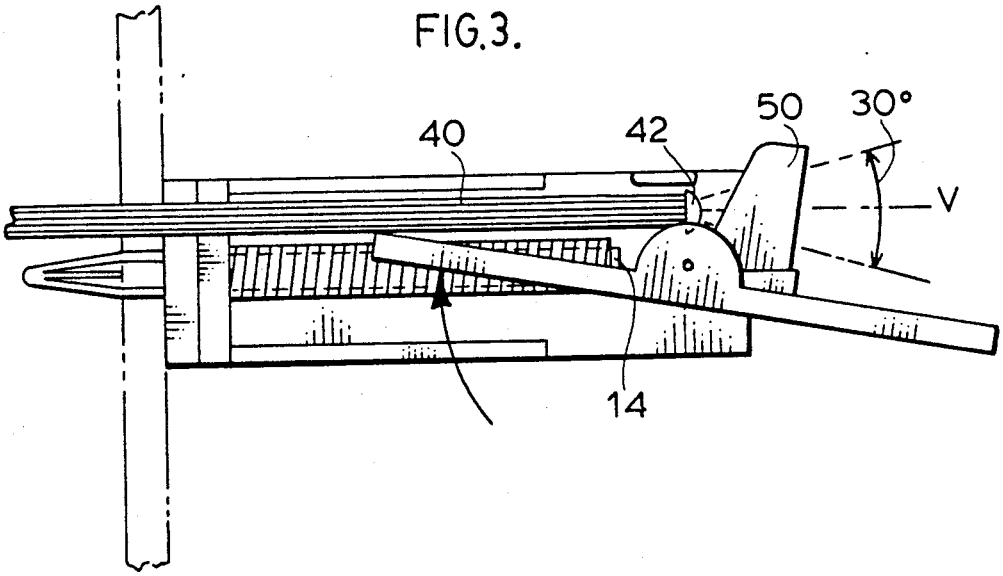
FIG. 3 is a side view in the RESET position.
Figure 4:
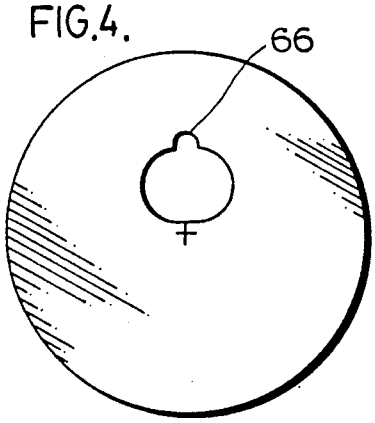
FIG. 4 shows a disk.
Figure 5:
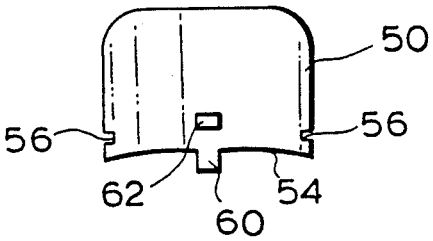
FIG. 5 shows a hood.
Figure 6:
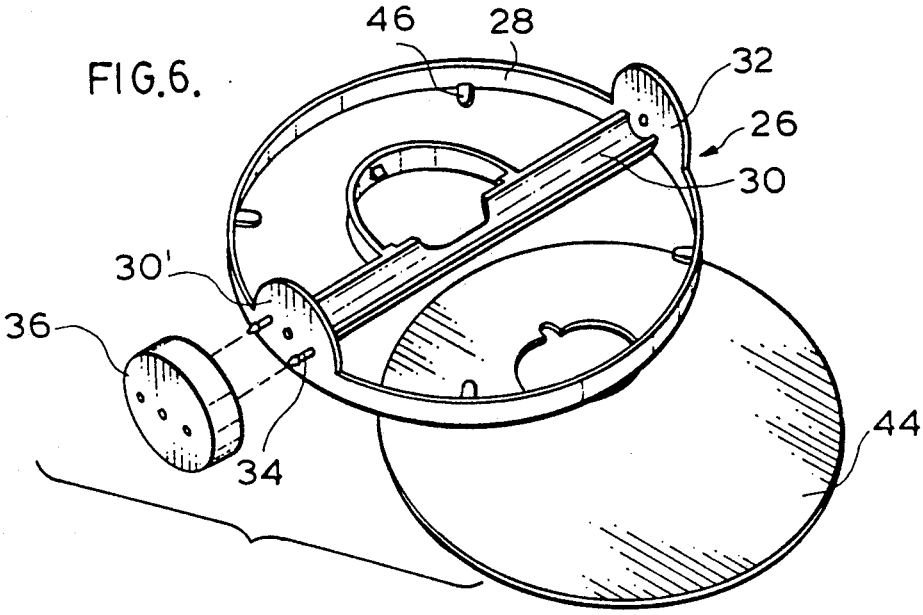
FIG. 6 shows the disk, magnet and frame assembly.

In the drawings, pillars 10 mounted on a base 11 mount pivot shaft 12 for the rotor or disk assembly. A second pillar 10, not shown will mount the free end of the disk assembly and will mount the next disk. Thus the pillar 10 carries drive means for the rotor shown. Mounted to project forwardly of base 11 is core 14 which is wound coil 16 projecting in the viewing direction to a location spaced from but aligned with the shaft 12.

It is desired to describe the rotor or shank assembly 26 in general and then in detail. The disk assembly comprises a frame 26 shaped to provide a circular rim 28 with a diametrically extending central bar 30. Extending from each end of the central bar are ears 32 apertured to receive shaft and dimensioned to allow the rotor to pivot thereon. One of the ears 30' is provided with outwardly projecting pins 34 on which the flat cylindrical permanent magnet 36 may be mounted to be coaxial with shaft 12 and apertured to receive it. The central bar 30 is provided with a curved strut 38, concave toward the bar and in the plane of rim 28 and joined thereto at ends equally spaced on each side of the centre of central bar 30. As shown central bar 30 is cut away over about half of its width at 40 facing strut 38. The central bar is customarily channel shaped to lend strength to the frame. The rim 28 is preferably a cylinder whose inside surface is coaxial with the pivot axis and at its forward edge has a number, here four, inwardly directed tabs 46. The frame and strut are one-piece molded plastic.

The frame as above described is preferably an integral unit of molded plastic with the separate magnet mounted thereon.

The magnet 36 magnetized to form diametrically directed north and south poles N and S directed as indicated.

The frame as above described mounts a circular disk 44 cut to rest inside rim 28. The disk is slightly resilient and is flexed to extend over central bar 30 and under tabs 46 with the bar and tabs arranged to create sufficient bias flexure in the disk that it is maintained frictionally in position.

The disk is apertured at a location registering with the space between the central bar cut out 40 and the strut 38. The aperture is oval being somewhat larger in the direction parallel to the pivot axis. The disk is brightly colored on the side to be perpendicular to the viewing direction in the SET position of the assembly. The disk is contrastingly colored on its other side and the base and components of the device also have such contrasting coloration in areas which register with the disk location in the latters SET position.

A hood 50 is stamped from a flat piece of flexible resilient opaque plastic to have a curved, rearward edge, a forward edge 54, a pair of outwardly directed open slots 56 on each side edge near the forward edge. The hood is also provided with a small projection 60 extending forward from the centre of the forward edge with an aperture 62 just rearwardly thereof.

Strut 38 and central bar 30 are provided to define outwardly facing ridges 63 at their junctions designed to fit in slots 56 when the hood is flexed for attachment to the frame. The hood is attached to ridges 63 as the first step of mounting. The hood is then pivoted forwardly about the pivot provided by ridges 63 and slots 56 and the central curved position of the hood is flexed and wedged until a projection 64 the centre of strut is received in aperture 62 to hold the hood firmly in position. It will be seen that ridges 63 maintain the bent and resilient hood against unbending while ridges 63 and projection 64 maintain the hood against movement in any direction perpendicualr to the pivot axis. At the same time projection 60 on the hood is received in a complementary cut out 66 on the outer aperture defining edges of the disk and keys the disk against rotation relative to the frame.

On one side of pillar 10 is a projection with a top edge 20 located to form the stop for the disk assembly in SET position.

The frame may also be designed to provide the stop for the assembly in RESET position.

However it is found that the fibre optic bundle to be described makes a suitable RESET stop.

The magnetic drive may be of any type well known to those skilled in the art. That shown has the magnet 36 , rotatable with the disk assembly polarized as indicated in close proximaty to the forward end of core 14. With a S' polarity of such forward end the N pole of the magnet holds the magnet in SET position with the frame bearing on stop 20. When the coil 16 is pulsed to reverse the polarity of core the new N' pole at the forward end repels the permanent magnet driving the disk assembly to RESET position. An opposite pulse in the winding will again reverse the magnetization of coil and drive the assembly back to SET position. The 'hard' magnetism of the core means that the energizing pulse may be very short relative to the mechanical time required for the disk to move since the core retains its 'last-pulsed' polarity between pulses. Thus the core's quiescent polarity maintains the disk in position between pulses.

A fibre bundle 40 is supported on the base to project to a forward terminal 42 adjacent the plane of the disk in SET position. The forward terminal is provided with a focussing lens which provides optical radiation at a solid angle of about 30° centred on the viewing direction. The bundle is illuminated by a light source not shown.

The forward terminal 42 may be just forwardly or rearwardly of the plane of the disk or coincide therewith since the radiation cone is preferably defined by the lens and not by the aperture. Thus when the fibre bundle is spoken of herein as providing radiation through the aperture, it is understood that this may be radiation from a terminal just rearwardly of the aperture or a fibre-carried radiation to the terminal just forward of the aperture becoming ordinary radiation forwardly of the terminal. Obviously if the fibre terminal is forward of the plane of the disk in the SET position, the geometry must be such that the outer edge of the disk aperture must clear the terminal or rotation as must the hood.

It is more or less coincidental that the fibre optic bundle may form the RESET stop for the disk. However a pillar stop may be provided if desired. The aperture is extended to allow for some movement of the disk along the shaft without preventing registration of the aperture with the fibre optic bundle or terminal.

The drive may be other than electromagnetic within the scope of the invention.

In operation with the core magnetized as shown (FIG. 2A) the disk assembly is in the SET position. A viewer looking in the viewing direction, in daylight sees a combination of the bright disk side and the fibre optic terminal at the disk location. At night the viewer sees the same combination but a far larger portion of the 'impression' is created by the fibre.

To place the disk in RESET position, the coil is pulsed, reversing the coil magnetization and driving the permanent magnet to the RESET position. In daylight or at night the side, and hood of the disk, and the portion of the mount and base registering with the disk's SET orientation present a dark appearance to the viewer while the hood occludes the fibre optic radiation from the viewer.

The simple mechanical attachment of the hood to the frame allows simple convenient construction of both members since the frame is simple to mold and the hood is a flat stamped member. The hood mounted near the outer edge of the disk aperture edge to be concave toward the aperture is located to be of minimum weight and dimensions. The mounting supplied by the frame and strut design is light and allows the frame and strut to be used for other display element applications.

Other mechanical connections between hood and frame are considered within the scope of the invention. The mechanical connection implies connection due to the qualities and shaping of the members themselves as distinct from the use of adhesive or other auxiliary fastening means. The fact that some fastener means such as adhesive and the like might in some cases be added after does not prevent the connection above defined being within the scope of the invention.

It is within the scope of the invention to use a single optic fibre instead of the fibre bundle 40. This is preferred. Such single fibre has also a lens at its forward end 42.

I claim:

1. Display device for display in a viewing direction comprising disk assembly including a disk, the assembly being rotable on a generally median axis from rotation between a SET position approximately perpendicular to a viewing direction and a RESET position approximately parallel to the viewing direction, stops for limiting rotation between said SET and RESET positions, an aperture in said disk, adjacent but offset from the pivot axis, a optical fibre terminal located to direct optic radiation through said aperture in the SET position, a hood mounted on said disk assembly located and shaped to project rearwardly therefrom in the SET position and to occlude in the RESET position and in the viewing direction radiation from the optic fibre terminal, said hood being concave toward and extending partially around said aperture, wherein said hood is mechanically attached to said disk assembly, means for selectively driving said disk between SET and RESET positions, wherein said hood is formed from a thin sheet of resilient material and said hood and disk are designed so that said bent hood flexes against detents on said disk assembly to be held in position.

2. Display device as claimed in claim 1 wherein said disk assembly comprises a frame and a circular disk mounted thereon, said disk is provided with said aperture wherein said hood is attached to said frame to partially surround the edge of said aperture on the outer side thereof.

3. Display device as claimed in claim 2 wherein said frame includes a pair of detents designed to retain the forward outer edges of said bent sheet against outward movement and wherein said frame is provided with means, in combination with said hood to prevent forward or rearward movement thereof.

4. Display device as claimed in claim 1 wherein said disk assembly comprises a frame and said disk is attached thereto where the frame comprises a peripheral ring and a diametrically extending central bar and having a curved strut in the general plane of the ring and with its ends attached to the central bar where the disk is apertured to allow a glass fibre terminal to radiate light in the viewing direction and said curved strut being shaped and located and to support said hood in position, said frame and strut designed to provide detents to prevent outward movement of the ends of said bent hood and said strut being provided with means in cooperation with said hood to prevent forward or rearward movement of said hood.

* * * * *